US010292420B2

(12) United States Patent
Fallon et al.

(10) Patent No.: US 10,292,420 B2
(45) Date of Patent: May 21, 2019

(54) APPARATUS FOR FORMING A CIRCUMFERENTIAL SLIT IN A TOBACCO INDUSTRY ROD ARTICLE

(71) Applicant: British American Tobacco (Investments) Limited, London (GB)

(72) Inventors: Gary Fallon, London (GB); Andrew Bray, London (GB); Kie Seon Park, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 368 days.

(21) Appl. No.: 15/103,601

(22) PCT Filed: Nov. 25, 2014

(86) PCT No.: PCT/EP2014/075573
§ 371 (c)(1),
(2) Date: Jun. 10, 2016

(87) PCT Pub. No.: WO2015/086314
PCT Pub. Date: Jun. 18, 2015

(65) Prior Publication Data

US 2016/0309778 A1 Oct. 27, 2016

(30) Foreign Application Priority Data

Dec. 11, 2013 (GB) ..... 1321887

(51) Int. Cl.
*A24D 3/02* (2006.01)
*A24C 5/47* (2006.01)

(52) U.S. Cl.
CPC ..... *A24D 3/0254* (2013.01); *A24C 5/478* (2013.01); *A24D 3/0258* (2013.01)

(58) Field of Classification Search
None
See application file for complete search history.

(56) References Cited

U.S. PATENT DOCUMENTS 4,232,574 A 11/1980 Hall
4,385,836 A 5/1983 Hall
6,302,113 B1 10/2001 Ozeray

FOREIGN PATENT DOCUMENTS

EP 0156531 A1 10/1985

OTHER PUBLICATIONS

International Search Report for corresponding application PCT/EP2014/075573 filed Nov. 25, 2014; dated Feb. 19, 2015.
Written Opinion for corresponding application PCT/EP2014/075573 filed Nov. 25, 2014; dated Feb. 19, 2015.
European Search Report for corresponding application EP 14 805 544.5; dated 22, 2017.

*Primary Examiner* — Dennis R Cordray
(74) *Attorney, Agent, or Firm* — Cantor Colburn LLP

(57) ABSTRACT

An apparatus for forming a circumferential slit in a tobacco industry rod article is disclosed. The apparatus comprises a drum and a rolling hand spaced apart from one another so as to form a space for a tobacco industry rod article, and a cutting element extending into the space and configured to form a circumferential slit in the tobacco industry rod article.

14 Claims, 6 Drawing Sheets

APPARATUS FOR FORMING A CIRCUMFERENTIAL SLIT IN A TOBACCO INDUSTRY ROD ARTICLE

FIELD OF THE INVENTION

This invention relates to an apparatus for forming a circumferential slit in a tobacco industry rod article. The invention also relates to a smoking article assembly machine comprising such an apparatus.

BACKGROUND

It is known to provide machines for assembling smoking articles such as cigarettes. These machines typically comprise a series of drums configured to transfer and/or assemble a filter rod with a tobacco rod so as to form a smoking article. Certain drums are configured so that particular operations are carried out as the rod articles are conveyed by the drum. For example, a drum may be configured to co-operate with a rolling hand to wrap a tipping paper segment around a filter rod and a tobacco rod so as to combine the two with one another, other drums are configured to co-operate with a laser beam so as to perforate the tipping paper.

SUMMARY

According to the present invention there is provided, an apparatus for forming a circumferential slit in a tobacco industry rod article, comprising a drum and a rolling hand spaced apart from one another so as to form a space for a tobacco industry rod article, and a cutting element extending into the space and configured to form a circumferential slit in the tobacco industry rod article.

In one embodiment, the space forms a channel through which tobacco industry rod articles can travel, and the channel has a cross-sectional profile having two points of inflection.

The drum may comprise a surface and the cutting element comprises a curved edge extending away from the surface of the drum.

In one embodiment, the space is defined by a surface of the rolling hand and the surface of the drum, and the surface of the drum comprises an arcuate recess that is concentric with the cutting element when the drum is in a specific position relative to the cutting element.

In another embodiment, at least an outer portion of the surface of the rolling hand is concentric with a region of the surface of the drum adjacent to the recess.

At least an inner portion of the surface of the rolling hand may be concentric with the curved edge of the cutting element.

In one embodiment, the drum is configured to rotate about an axis, and the length of the recess in a direction about the axis is greater than the circumference of the tobacco industry rod article.

In another embodiment, the space is defined by a surface of the rolling hand and a surface of the drum, and wherein one or both said surfaces are shaped so that the slit has a constant or substantially constant depth around the tobacco industry rod article.

The cutting element may be rotationally attached to the rolling hand, and the cutting element may be configured to have a higher rpm than the drum during use.

The cutting element may comprise one or more circular knives.

In one embodiment, the cutting element is movable relative to the rolling hand so that the extent of which the cutting element extends into the space can be adjusted.

In another embodiment, the apparatus may further comprise an adjuster to which the rolling hand is attached, the adjuster is configured so as to move the rolling hand relative to the drum so as to adjust the width of the space.

In one embodiment, adjuster comprises a pivoting arm and a connecting member connecting the rolling hand to the pivoting arm, and the connecting member is moveable in a direction perpendicular to the direction in which the arm extends.

The surface of the drum may be formed with a groove for receiving a tobacco industry rod article.

In one embodiment, the rolling hand is formed with a lip such that a tobacco industry rod article held in the groove is prompted out of its groove.

According to another aspect of the invention, there is provided a smoking article assembly machine comprising an apparatus comprising any of the features described above.

BRIEF DESCRIPTION OF THE DRAWINGS

Embodiments of the invention will now be described, by way of example only, with reference to the accompanying drawings in which.

DETAILED DESCRIPTION

Figure 1:
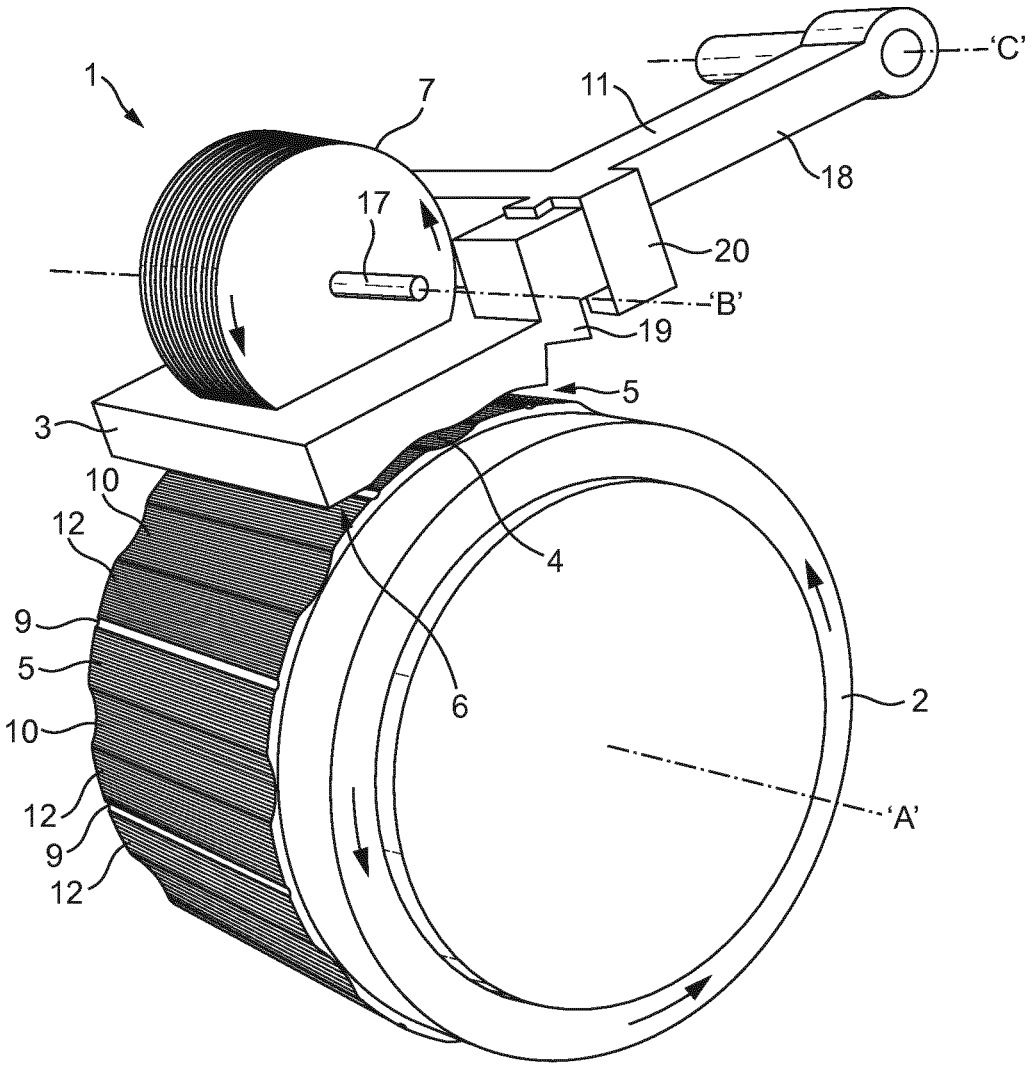
FIG. 1 shows a perspective view of an apparatus according to the present invention.

Referring now to the drawings, FIG. 1 shows an apparatus 1 for forming a circumferential slit in a tobacco industry rod article. The term "tobacco industry rod article" includes a rod such as tobacco rod, filter rod, other rod-like articles suitable for inclusion in a smoking article, and a smoking article itself. A tobacco industry rod article may be formed from a single rod, or alternatively may comprise two or more rod segments.

The term "smoking article" includes smokeable products such as cigarettes, cigars and cigarillos whether based on tobacco, tobacco derivatives, expanded tobacco, reconstituted tobacco or tobacco substitutes and also heat-not-burn products. The smoking article may be provided with a filter for the gaseous flow drawn by the smoker.

As shown in FIG. 1, the apparatus 1 comprises a cylindrical drum 2 and a rolling hand 3 spaced apart from one another so as to form a space 4. The space 4 forms a channel having an entry feed 5 and an exit feed 6. The drum 2 is configured to carry tobacco industry rod articles into the entry feed 5, through the channel, and out through the exit feed 6. The apparatus 1 further comprises a cutting element 7 extending into the space 4. The cutting element 7 cuts a circumferential slit in each tobacco industry rod article as they travel through the space 4. The apparatus 1 also comprises an adjuster 11 configured to adjust the width of the space 4.

The drum 2 will now be described in more detail with reference to FIGS. 1 and 2. The drum 2 is configured to rotate about an axis 'A' in an anti-clockwise direction as indicated by the arrows in FIG. 1. The drum 2 comprises a surface 8 formed with arcuately shaped recesses 10 that extend in a direction parallel to the axis 'A' of the drum 2. The recesses 10 are symmetrically arranged on the surface 8 about the axis 'A' of the drum 2. However, although the figures show a plurality of recesses 10 it should be understood that the surface 8 of the drum 2 may be formed with a single recess 10.

The recesses 10 have an arcuate profile and the length of the arc may be greater than the circumference of the tobacco industry rod article so as to ensure that a complete circumferential slit is formed.

The regions 12 of the surface 8 adjacent the recesses 10 are formed with grooves 9 and so it should be understood that these adjacent regions 12 as well as grooves 9 are located on either side of each recess 10.

The grooves 9 are configured to holding at least one tobacco industry rod article. The grooves 9 extend parallel to the axis 'A' of the drum 2 and are configured to apply suction to the tobacco industry rod article so as to retain said tobacco industry rod article in its respective groove 9 as the drum 2 rotates. The grooves 9 are formed symmetrically on the surface 8 of the drum 2 about the axis 'A' as best seen in FIG. 1, however this is optional. It should also be understood that the grooves may be omitted such that tobacco industry rod articles do not have designated locations on the surface 8 of the drum 2.

The rolling hand 3 will now be described in more detail with reference to FIGS. 1 and 3. The rolling hand 3 comprises a surface 13 which together with the surface 8 of the drum 2 define the space 4. The surface 13 of the rolling hand 3 comprises outer 14*a*, 14*b* and inner portions 15. The outer portions 14*a*, 14*b* are arcuately shaped and are concentric with the regions 12 of the surface 8 of the drum 2. The inner portion 15 is located between the outer portions 14*a*, 14*b*, and the inner portion 15 is also arcuately shaped, however its curvature extends in the opposite direction to the outer portions 14*a*, 14*b*.

Although not illustrated, it is envisaged that the outer portion 14*a* at the entry feed 5 may be formed with a lip or a kicker bar which assists a tobacco industry rod article to be forced out of its groove 9 as it enters the space 4.

The surfaces 8, 13 of the drum 2 and the rolling hand 3, may be ribbed as shown in the figures, however this is optional.

The cutting element 7 will now be described with reference to FIGS. 1 and 3. The cutting element 7 comprises a plurality of circular knives having an arcuate edge 16 that extend away from the surface 8 of the drum 2. In alternative embodiments the cutting element may comprise a singular knife having an arcuate edge that extends away from the surface 8 of the drum 2. Furthermore, the cutting element 7 is not limited to being circular, it may be of any other shape comprising an arcuate edge(s).

The cutting element 7 extends into the space 4 through an opening formed in the inner portion 15 of the surface 13 of the rolling hand 3. The inner portion 15 of the surface 13 of the rolling hand 3 is concentric with the arcuate edges 15 of the cutting element 7. Furthermore, when the drum 2 is in a specific position as shown in FIGS. 1 to 3, one of the recesses 10 is concentric with the arcuate edges 15 of the cutting element 7. Thus, each recess 10 can also be described to be concentric with the inner portion 15 of the surface 13 of the rolling hand 3 when the drum 2 is in a relevant specific position. Therefore, when the drum 2 is in a specific position a portion of the surface 8 of the drum 2 follows the contour of the surface 13 of the rolling hand 3.

In view of the relationship between the surface 8 of the drum 2 and the surface 13 of the rolling hand 3 with respect to the cutting element 7, the channel formed by the space 4 between said surfaces 8, 13 may therefore be described as having a cross-sectional profile comprising two points of inflection.

As a result of the shape of the surface 13 of the rolling hand 3 and the surface 8 of the drum 2, or more specifically the inner portion of the surface 13 of the rolling hand 3 and the recesses 10 of the surface 8 of the drum 2 being concentric with the cutting element 7, a tobacco industry rod article passing through the space can be cut such that the slit has a constant or substantially constant depth around the tobacco industry rod article.

The cutting element 7 is rotationally attached to the rolling hand 3 such that it can rotate about an axis 'B'. The cutting element 7 rotates about an axle pin 17 which is attached to the rolling hand 3. The axle pin 17 is parallel to the rotational axis 'A' of the drum 2. It is envisaged that the axle pin 17 can be moved closer or further away from the rotational axis 'A' of the drum 2 so that the extent of which the cutting element 7 extends into the space 4 can be adjusted.

Figure 2:
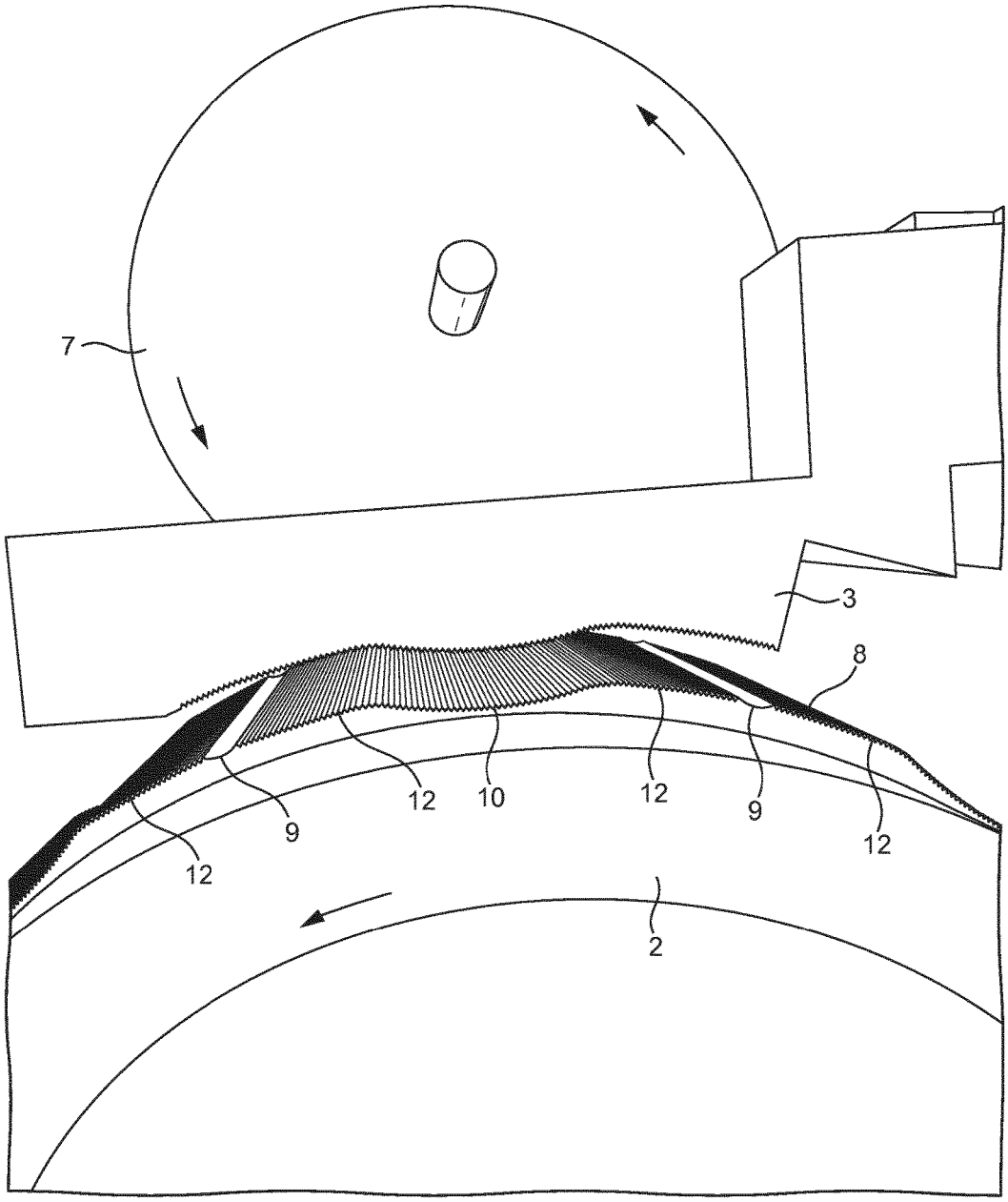
FIG. 2 shows a close-up view of the front of the apparatus shown in FIG. 1.
Figure 3:
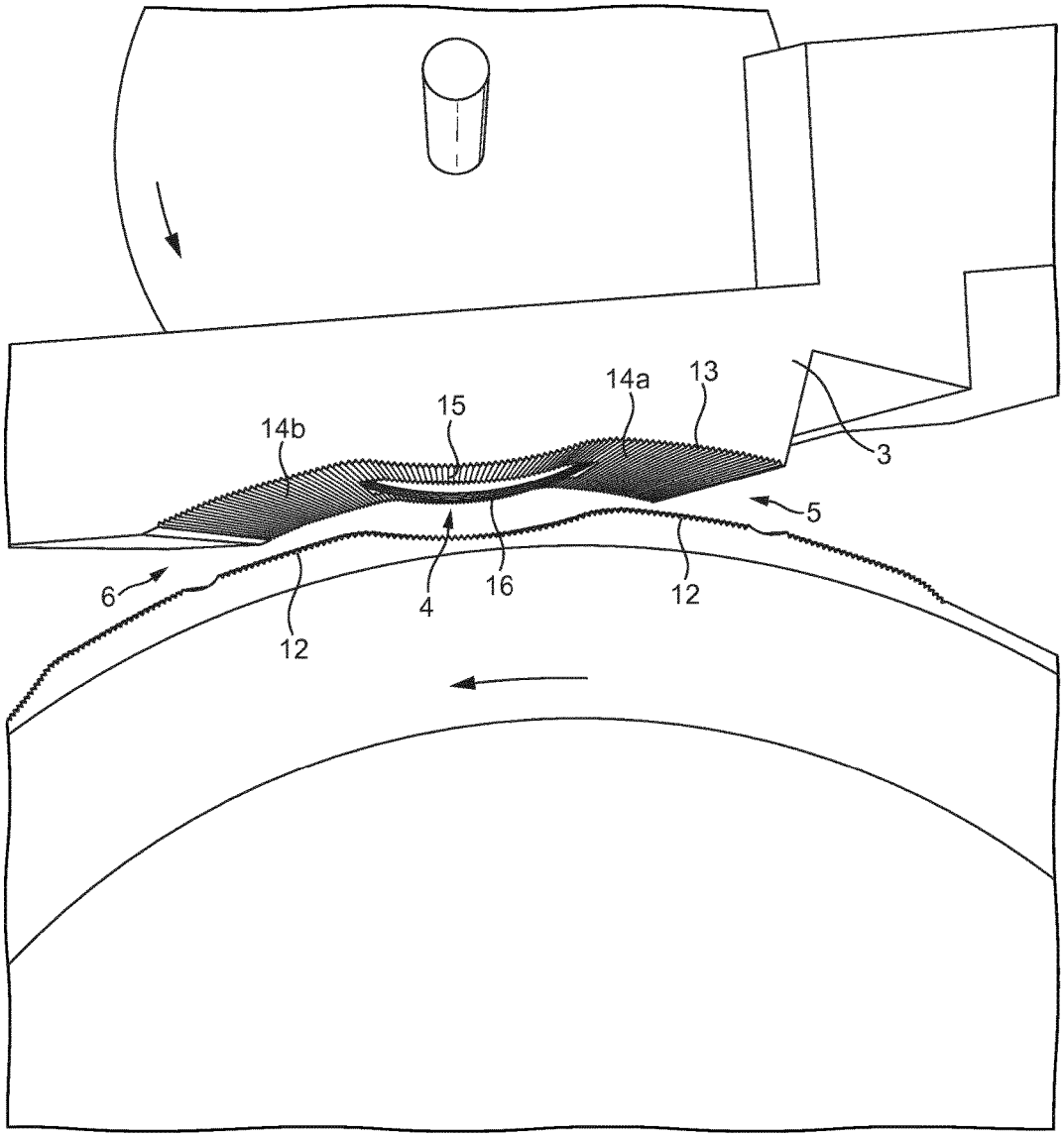
FIG. 3 shows another dose-up view of the front of the apparatus shown in FIG. 1.

The cutting element 7 rotates in an anti-clockwise direction as indicated by the arrows in FIGS. 1 to 3. However, it may rotate in a clockwise direction. The cutting element 7 may also rotate at a higher number of rotations per minute (rpm) than the drum 2 so as to improve the cutting of the tobacco industry rod article. However, it should be understood that the cutting element 7 does not have to rotate. In an alternative embodiment, the cutting element is static.

The rolling hand 3 is attached to the adjuster 11 as can best be seen in FIG. 1. The adjuster 11 comprises a pivoting arm 18 and a connecting member 19. The pivoting arm 18 comprises two opposing ends. One end is configured to pivot about an axis 'C', and the opposite end is formed with a connecting unit 20 which connects with the connecting member 19.

The connecting member 19 is fixedly attached or integrally formed with the rolling hand 3 and connects with the connecting unit 20 via dovetail connection which enables the connecting member 19 to move in a direction transverse to the direction in which the pivoting arm 18 extends. It should be understood that an alternative connection between the connecting member 19 and the connecting unit 20 may be used which enables them to move relative to one another in a direction transverse to the pivoting arm 18.

As a result of the adjuster 11 enabling the pivoting arm 18 to rotate about axis 'C' and the connecting member 19 to move in a direction transverse to the pivoting arm 18, the rolling hand 3 is movable relative to the drum 2 so as to adjust the width of the space 4. The width of the space 4 should be understood to be the distance between the surface 8 of the drum 2 and the surface 13 of the rolling hand 3.

The space 4 between the drum 2 and the rolling hand 3 is set to be of a width that is smaller than the diameter of the tobacco industry rod article, such that the tobacco industry rod article is compressed. This enables the tobacco industry rod article to rotate about its own axis as it travels through the space 4.

Figure 4:
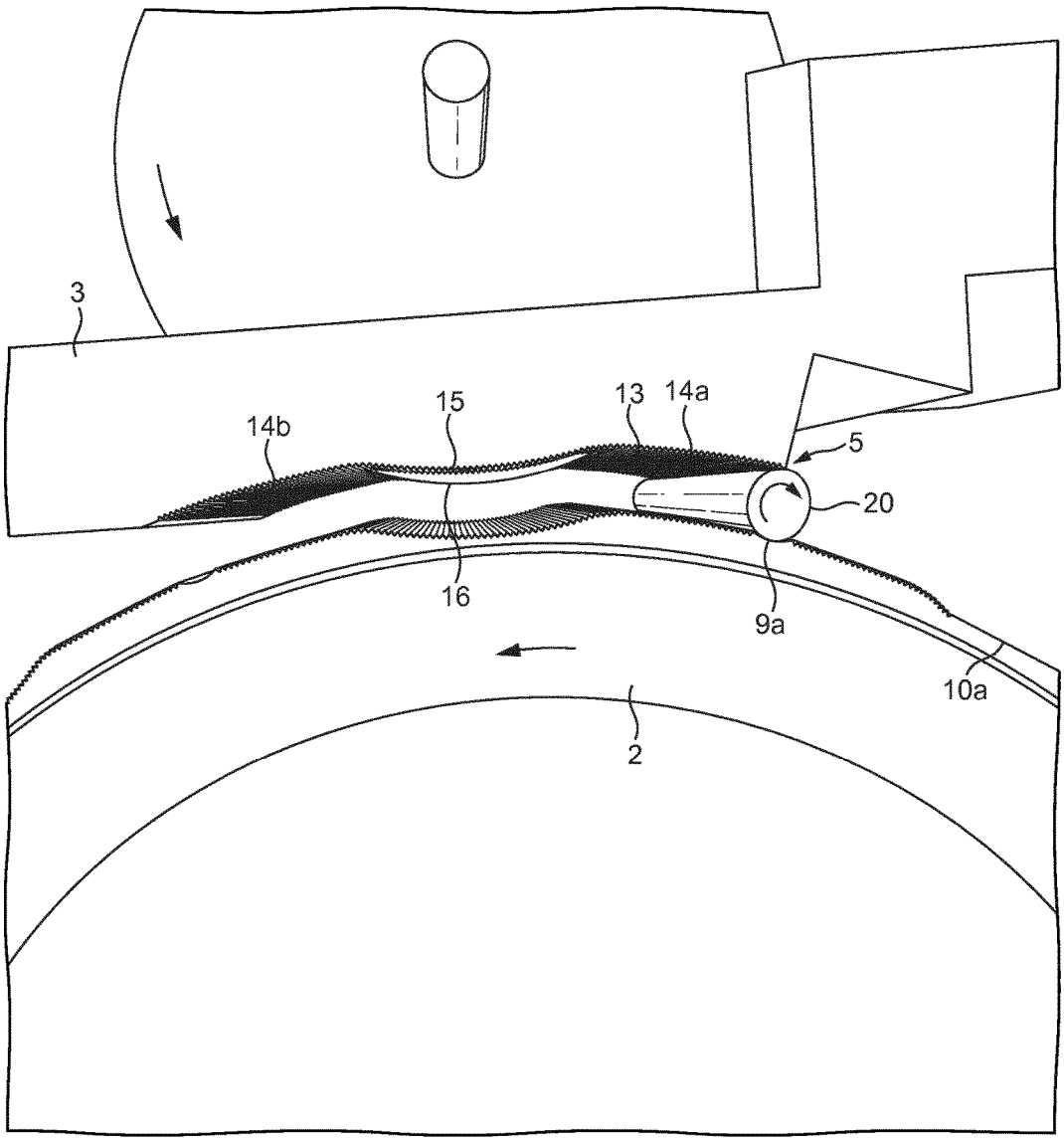
FIG. 4 shows a close-up view of the front of the apparatus shown in FIG. 1 with a tobacco industry rod article entering a space.
Figure 5:
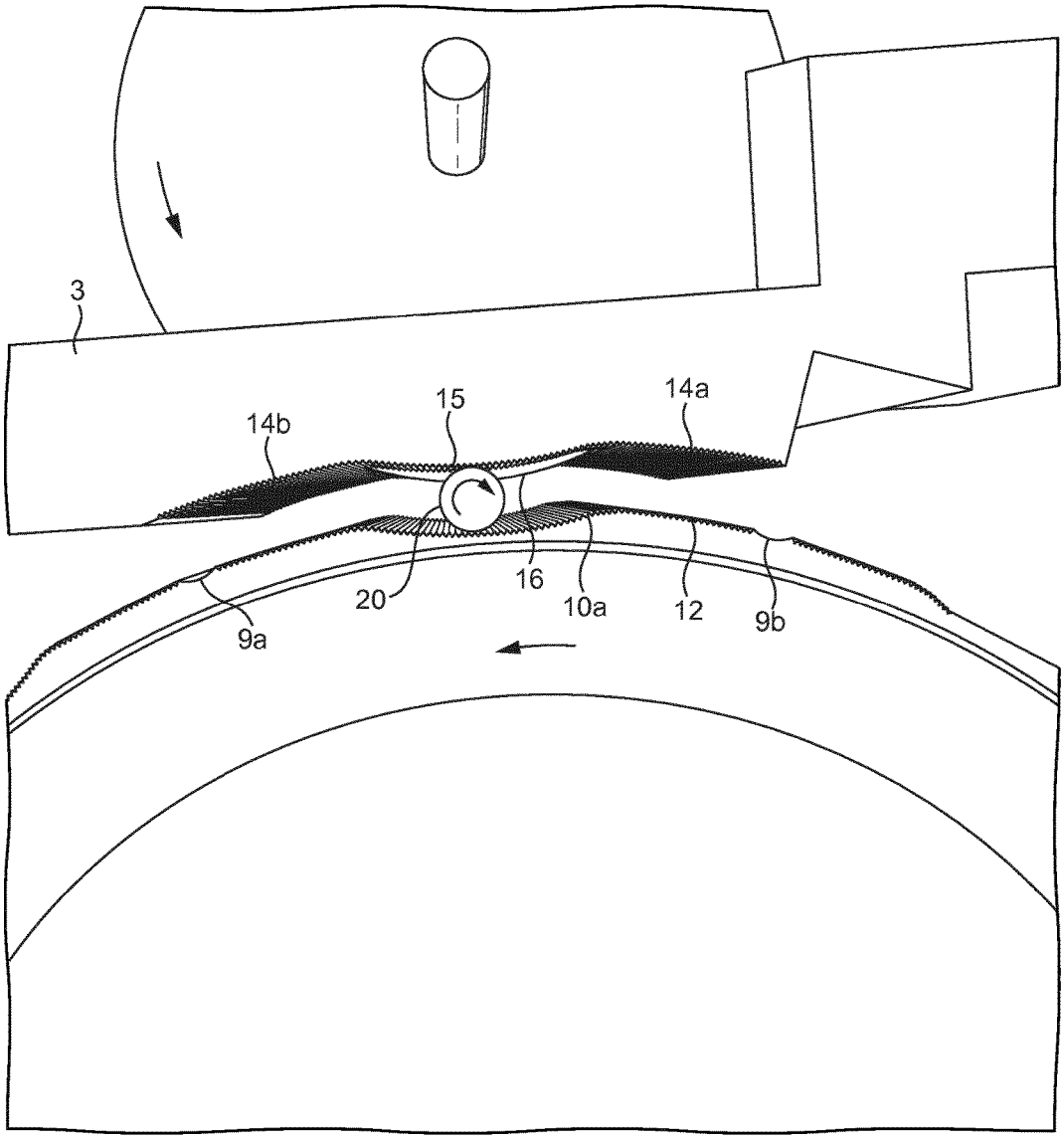
FIG. 5 shows a close-up view of the front of the apparatus shown in FIG. 1 with a tobacco industry rod article passing through the space.
Figure 6:
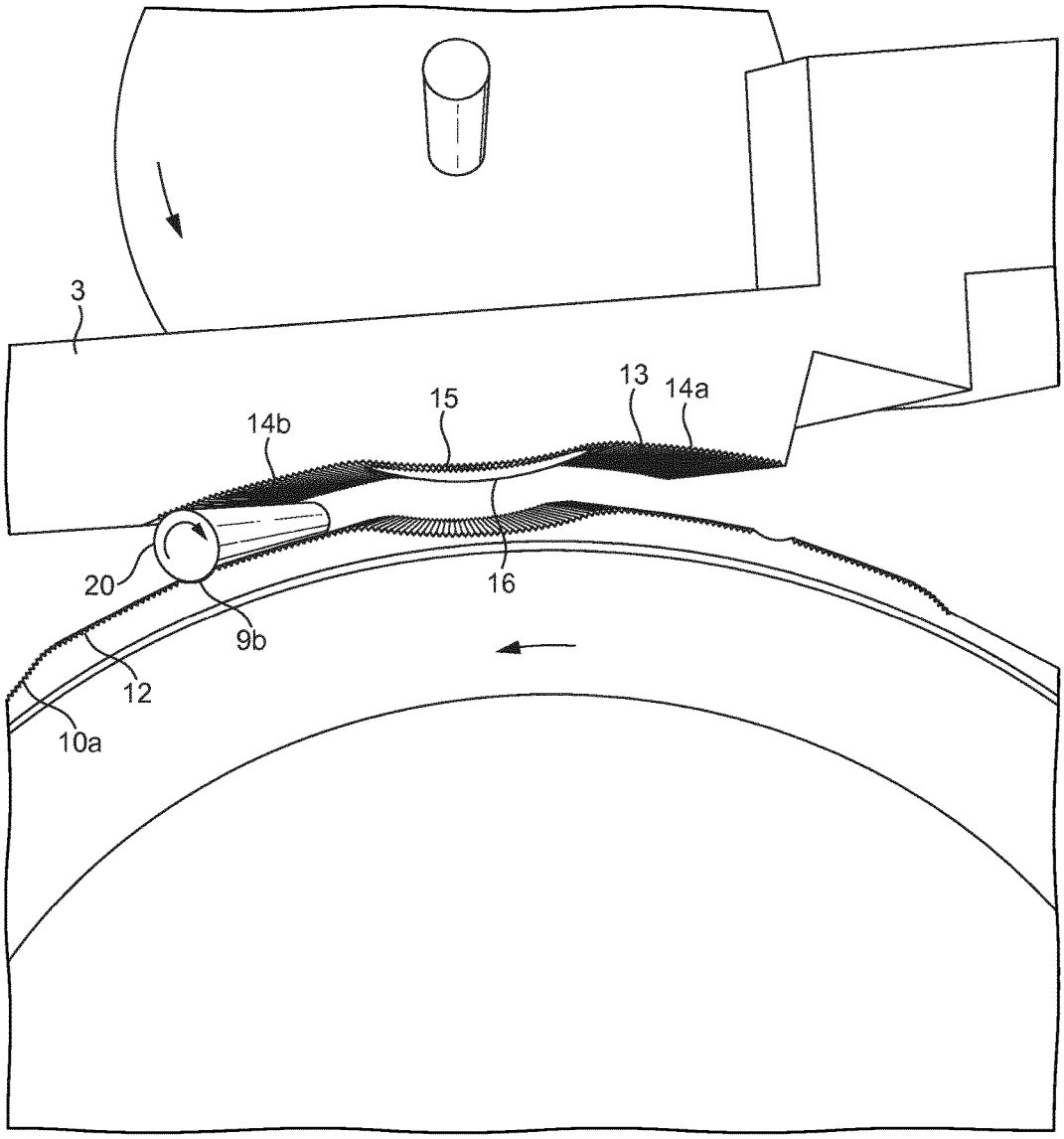
FIG. 6 shows a close-up view of the front of the apparatus shown in FIG. 1 with a tobacco industry rod article exiting the space.

Operation of the apparatus 1 will now be described with reference to FIGS. 4 to 6. A tobacco industry rod article 20 is located in a groove 9*a* and the drum rotates in an anti-clockwise direction as indicated by the arrow. When the tobacco industry rod article 20 reaches the entry feed 5 the tobacco industry rod article 20 is prompted out of its groove 9*a* due to the width of the space 4 being smaller than the diameter of the tobacco industry rod article 20. A lip located on the outer portion 14*a* of the surface 13 of the rolling hand 3 may also be used to force the tobacco industry rod article 20 out of its groove 9*a*. As the drum 2 continues to rotate in an anti-clockwise direction the tobacco industry rod article rotates about its own axis in a clockwise direction. As a result, the tobacco industry rod article 20 moves through the space 4 in the direction as which the drum rotates 2. Thus, the tobacco industry rod article rotates into the recess boa located after the groove 9*a* which it was initially received in as the recess aligns with the cutting element 7 as illustrated in FIG. 5. This causes the cutting element 7 to cut a circumferential slit of constant depth into the tobacco industry rod article 20. Thereafter, the tobacco industry rod article 20 continuous to travel through the space between the region 12 adjacent the recess boa and the outer portion 14*b* of the surface 13 of the rolling hand 3 such that it then locates in the next groove 9*b* as illustrated in FIG. 6. Thus, the tobacco industry rod article 20 travels towards the space 4 in a first groove 9*a* and travels away from the space 4 in the next groove 9*b* along from the first groove 9*a*.

Although not shown, the tobacco industry rod article 20 formed with a circumferential slit is thereafter transferred to a transfer drum or another drum with a specific operation. Alternatively, the tobacco industry rod article 20 is transferred to a packaging stage.

It should be understood that the apparatus 1 may be used or combined with any other appropriate operation. For example, the apparatus may also be configured to apply tipping paper to the tobacco industry rod article prior to or subsequent the cutting element 7. Alternatively, the apparatus 1 may also be configured to cut a filter rod in half adjacent the circumferential slit so as to produce two tobacco industry rod articles each having a circumferential slit. However, the apparatus is not limited to a particular operation besides the circumferential cutting as the tobacco industry rod articles are conveyed by the drum.

It is also envisaged that each groove can hold a plurality of tobacco industry rod articles so that in the embodiment where the cutting element comprises a plurality of knives, the plurality of tobacco industry rod articles can be cut simultaneously.

Furthermore, the depth of the slit may be altered as described above and so the apparatus may be used to cut one layer or several layers of the tobacco industry rod article. For example, if the tobacco industry rod article comprises a filter rod wrapped in plug wrap and a tobacco rod wrapped in cigarette paper, and the filter rod and the tobacco rod is combined with one another by tipping paper, the apparatus may be configured to cut a circumferential slit in any of these layers. For instance, the apparatus may be configured to cut through the tipping paper in the region of the filter rod and/or the tobacco rod. The apparatus may also be configured to cut into the deeper layers such as the plug wrap, filter, cigarette paper and/or tobacco.

The apparatus 1 may also cut a circumferential slit or several slits at any point along the tobacco industry rod article and so it is not limited to a particular region or area of the tobacco industry rod article.

A circumferential slit of a tobacco industry rod article has several applications. For example, a circumferential slit may be formed in the tipping paper in the region of the filter so that a portion of the tipping paper is rotatable relative to the remainder of the tipping paper. A circumferential slit may also be formed in the tipping paper and/or the filter so as to provide ventilation. Another application is to form two circumferential slits in the tipping paper so as to form a rotational mid-portion. This mid-portion can also be removed so as to expose the material underneath.

Furthermore, it is envisaged that the apparatus 1 may be included in a series of drums forming a smoking article assembly machine. The smoking article assembly machine may be a modular smoking article assembly machine, wherein each module comprises a drum or a set of drums.

In order to address various issues and advance the art, the entirety of this disclosure shows by way of illustration various embodiments in which the claimed invention(s) may be practiced and provide for a superior apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus for forming a circumferential slit in a tobacco industry rod article, comprising a drum and a rolling hand spaced apart from one another so as to form a space for a tobacco industry rod article, and a cutting element extending into the space and configured to form a circumferential slit in the tobacco industry rod article, wherein the space is defined by a surface of the rolling hand and a surface of the drum, the surface of the drum configured to be in contact with the tobacco industry rod article in use, and wherein one or both of said surfaces are shaped so that the slit has a substantially constant depth around the tobacco industry rod article.

2. An apparatus according to claim 1, wherein the drum has a rotational axis and the space forms a channel through which tobacco industry rod articles can travel, and the channel has a cross-sectional profile, the cross section being taken through a plane perpendicular to the rotational axis of the drum, such that when viewed in a direction of the rotational axis of the drum, the cross-sectional profile of the channel has two points of inflection.

3. An apparatus according to claim 1, wherein the drum comprises a surface and the cutting element comprises a curved edge extending away from the surface of the drum.

4. An apparatus according to claim 3, wherein the space is defined by a surface of the rolling hand and the surface of the drum, and the surface of the drum comprises an arcuate recess that is concentric with the cutting element when the drum is in a specific position relative to the cutting element.

5. An apparatus according to claim 4, wherein at least an outer portion of the surface of the rolling hand is concentric with a region of the surface of the drum adjacent to the recess.

6. An apparatus according to claim 4, wherein at least an inner portion of the surface of the rolling hand is concentric with the curved edge of the cutting element.

7. An apparatus according to claim 4, wherein the drum is configured to rotate about an axis, and the length of the recess in a direction about the axis is greater than the circumference of the tobacco industry rod article.

8. An apparatus according to claim 1, wherein the cutting element is rotationally attached to the rolling hand.

9. An apparatus according to claim 8, wherein the cutting element is configured to have a higher rpm than the drum during use.

10. An apparatus according to claim 1, wherein the cutting element comprises one or more circular knives.

11. An apparatus according to claim 1, wherein the cutting element is movable relative to the rolling hand so that the extent of which the cutting element extends into the space can be adjusted.

12. An apparatus according to claim 1, further comprising an adjuster to which the rolling hand is attached, the adjuster is configured so as to move the rolling hand relative to the drum so as to adjust the width of the space.

13. An apparatus according to claim 12, wherein the adjuster comprises a pivoting arm and a connecting member connecting the rolling hand to the pivoting arm, and the connecting member is moveable in a direction perpendicular to the direction in which the arm extends.

14. A smoking article assembly machine comprising an apparatus according to claim 1.

* * * * *